US005823203A

United States Patent [19]

Carroll et al.

[11] Patent Number: 5,823,203

[45] Date of Patent: Oct. 20, 1998

[54] APPARATUS AND METHOD FOR REMOVING ARTIFICIAL FINGERNAILS AND FINGERNAIL POLISH

[76] Inventors: George H. Carroll, 2392 Foster Ave., Ventura, Calif. 93001; Arthur A. Krause, 20642 Skouras Dr., Canoga Park, Calif. 91306

[21] Appl. No.: 647,008

[22] Filed: May 9, 1996

[51] Int. Cl.[6] ..... A45D 29/00

[52] U.S. Cl. ..... 132/200; 15/167.3; 132/75.8; 132/76.4; 132/74.5

[58] Field of Search ..... 132/73, 73.5, 73.6, 132/74.5, 75.6, 76.4, 76.5, 161, 120; 401/127, 129, 130; 15/167.3

[56] References Cited

U.S. PATENT DOCUMENTS

| | | | |
|---|---|---|---|
| 26,629 | 12/1859 | Thomson | 15/167.3 |
| 707,574 | 8/1902 | Flemming | 132/120 |
| 1,750,451 | 3/1930 | Wrightson et al. | 132/75.6 |
| 2,580,981 | 1/1952 | Webster . | |
| 2,629,124 | 2/1953 | Merritt . | |
| 2,703,422 | 3/1955 | Roosa . | |
| 2,713,693 | 7/1955 | Johnson . | |
| 3,316,922 | 5/1967 | Seidler . | |
| 4,022,228 | 5/1977 | Ropp et al. . | |
| 4,255,826 | 3/1981 | Boyd . | |
| 4,319,596 | 3/1982 | Jackson | 132/75.6 |
| 4,321,936 | 3/1982 | Chaconas . | |
| 4,397,324 | 8/1983 | Thomas, Jr. . | |
| 4,510,954 | 4/1985 | Miller . | |
| 4,730,361 | 3/1988 | Koffler | 132/120 |
| 4,819,672 | 4/1989 | Walker et al. . | |
| 5,007,441 | 4/1991 | Goldstein . | |
| 5,048,547 | 9/1991 | Walker . | |
| 5,054,503 | 10/1991 | Keller . | |
| 5,065,778 | 11/1991 | Terrell . | |
| 5,379,474 | 1/1995 | Nakamura . | |
| 5,388,597 | 2/1995 | Smith et al. . | |
| 5,479,951 | 1/1996 | Denebeim | 132/120 |
| 5,613,506 | 3/1997 | Kurokawa | 132/74.5 |

FOREIGN PATENT DOCUMENTS

| | | | |
|---|---|---|---|
| 140991 | 3/1935 | Austria | 15/167.3 |

*Primary Examiner*—Todd E. Manahan
*Attorney, Agent, or Firm*—Dennis H. Lambert

[57] ABSTRACT

An apparatus for removing artificial fingernails and/or fingernail polish includes a receptacle holding a quantity of solvent for dissolving artificial fingernails and/or fingernail polish. The receptacle has an open top through which all the fingers of a user's hand can be inserted simultaneously to immerse the user's fingertips in the solvent. An annular brush is secured inside the receptacle in position to engage the fingernails of fingers inserted through the open top, for scuffing the fingernails to facilitate dissolving and removing fingernail polish and/or artificial fingernails from the fingers of the user. A rotatable finger support and locating device is positioned concentrically with the annular brush to assist in properly supporting and locating the fingers of the user relative to the brush, and a splash shield is positioned around the periphery of the open top to minimize splashing of solvent from the receptacle during use. The user's fingers from which fingernail polish and/or artificial fingernails are to be removed can be inserted into the apparatus and into contact with the brush and then moved back and forth relative to the brush for manual operation of the apparatus, or the apparatus may be motor driven to move the brush in one or both directions of rotation relative to the user's fingers for mechanized operation of the apparatus.

34 Claims, 8 Drawing Sheets

APPARATUS AND METHOD FOR REMOVING ARTIFICIAL FINGERNAILS AND FINGERNAIL POLISH

BACKGROUND OF THE INVENTION

1. Field of the Invention

This invention relates generally to the art of manicuring, and more particularly, to the removal of artificial fingernails and fingernail polish.

2. Prior Art

Fingernail polish and artificial fingernails are in widespread use as cosmetic enhancements, and are applied by the consumer as well as by professionals in salons. Artificial fingernails are typically produced either by gluing on premanufactured acrylic fingernails, or built up using an artificial fingernail form to apply layers of acrylic materials that are shaped to form an artificial fingernail. Although modern materials and methods enable very real looking artificial fingernails to be produced, it is necessary to periodically repair or remove the artificial fingernails.

Artificial fingernails and fingernail polish are generally removed by immersing the wearer's fingertips in a solvent to soften and dissolve the polish and the glues and acrylics comprising the artificial fingernails. Some prior art techniques also use scuffing means to abrade or peel away the artificial fingernail as it is softened and dissolved. Acetone is generally used as the solvent, and because this material is a powerful chemical, the wearer's fingers are usually protected with a skin protector before the wearer's fingertips are immersed in the solvent. Some formulations which contain acetone for dissolving artificial fingernails and fingernail polish also contain materials intended to protect and condition the skin of the wearer's fingers.

Acetone is a volatile material and evaporates quickly, producing gaseous compounds that may irritate the throat, lungs and eyes of exposed individuals. Further, the acetone may damage adjacent furniture, carpet and other objects if it is spilled or splashed onto these surfaces. Exposure to the gaseous compounds resulting from use of acetone generally does not pose a problem for the average consumer, since the consumer is only relatively infrequently exposed to these compounds. However, professional manicurists and beauticians may be exposed to acetone on a daily basis. Over time, contact with acetone can pose a serious health hazard.

Various devices have been developed in the prior art in order to facilitate the removal of fingernail polish and artificial fingernails, and especially to reduce the hazards associated with the use of strong solvents to remove the fingernail polish and artificial fingernails. Exemplary of such devices are those described in U.S. Pat. Nos. 2,580,981, 2,629,124, 2,703,422, 2,713,693, 3,316,922, 4,022,228, 4,255,826, 4,321,936, 4,397,324, 4,510,954, 5,007,441, 5,048,547, 5,054,503, 5,065,778 and 5,388,597. Many of these prior art device utilize covers or slitted diaphragms, etc., to minimize evaporation of the solvent and to minimize exposure of the manicurist or wearer to the solvent. Other devices include sponges, brushes or other scuffing materials to hasten softening and removal of the fingernail polish and/or artificial fingernails. U.S. Pat. Nos. 4,510,954, 5,007,441, 5,065,778 and 5,388,597, in particular, disclose devices having multiple apertures so that more than one finger can be treated simultaneously. Most prior art devices, however, enable only one finger at a time to be treated for removing the fingernail polish and/or artificial fingernails, whereby the process of removing fingernail polish and artificial fingernails from all ten fingers is very time consuming. Further, many of these devices, and especially those which permit simultaneous treatment of multiple fingers, are relatively complex and expensive in construction, and/or have fixed positions for inserting the fingers so that they are not always suitable or comfortable for use by all persons.

Accordingly, there is need for a method and apparatus for removing fingernail polish and artificial fingernails simultaneously from plural fingers, which is simple and inexpensive to manufacture, and which may be easily and comfortably used to remove fingernail polish and/or artificial fingernails from a wide range of different size hands.

SUMMARY OF THE INVENTION

An object of the invention is, therefore, to provide a simple and inexpensive apparatus for simultaneously removing fingernail polish and/or artificial fingernails from a plurality of fingers, and which is easy and comfortable to use with a wide range of different size hands.

Another object is to provide a method and apparatus for removing fingernail polish and/or artificial fingernails, wherein a finger support is provided for properly positioning and supporting the fingers in the apparatus.

A further object is to provide an apparatus for removing fingernail polish and artificial fingernails, wherein a circumferential brush means is supported in a receptacle containing a solvent, and a shaped finger support is located centrally in the device for supporting the fingers in any one of a plurality of different positions relative to the brush so that the fingers may be optimally positioned for removal of the fingernail polish or artificial fingernail.

Yet another object of the invention is to provide a device for holding a solvent to soften, dissolve and remove fingernail polish and/or artificial fingernails, wherein a splash guard is provided to minimize spillage or splashing of the solvent from the device.

The foregoing and other objects and advantages of the invention are achieved by providing a receptacle that holds a quantity of solvent for dissolving artificial fingernails and/or fingernail polish. The receptacle has an open top through which all the fingers of a wearer's hand can be inserted simultaneously to immerse the wearer's fingertips in the solvent. An annular brush is secured inside the receptacle in position to engage the fingernails of the wearer's fingers inserted through the open top, for scuffing or abrading the fingernails to facilitate dissolving and removing fingernail polish and/or artificial fingernails from the wearer's fingers. A rotatable finger support and locating device is positioned concentrically with the annular brush to assist in properly supporting and locating the finger of the wearer relative to the brush, and a splash shield is positioned around the periphery of the open top to minimize splashing of solvent from the receptacle during its use. The wearer's fingers from which fingernail polish and/or artificial fingernails are to be removed can be inserted into the apparatus and into contact with the brush and then moved back and forth relative to the brush for manual operation of the apparatus, or the apparatus may be motor driven to move the brush in one or both directions of rotation relative to the wearer's fingers for mechanized operation.

The rotatable finger support makes the device more comfortable and easy to use, and is shaped so that the finger can be placed thereon in different orientations for optimum contact between different parts of the fingernail with the brush means.

The components comprising the apparatus of the invention are easily and economically produced from molded synthetic plastic materials and are easily and economically assembled to form the completed apparatus.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
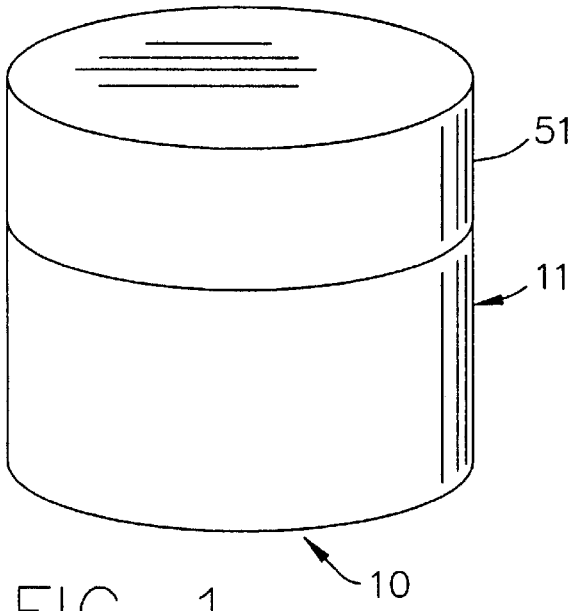
FIG. 1 is a top perspective view of the basic apparatus of the invention, which may be used either manually or with a motor driven appliance.
Figure 2:
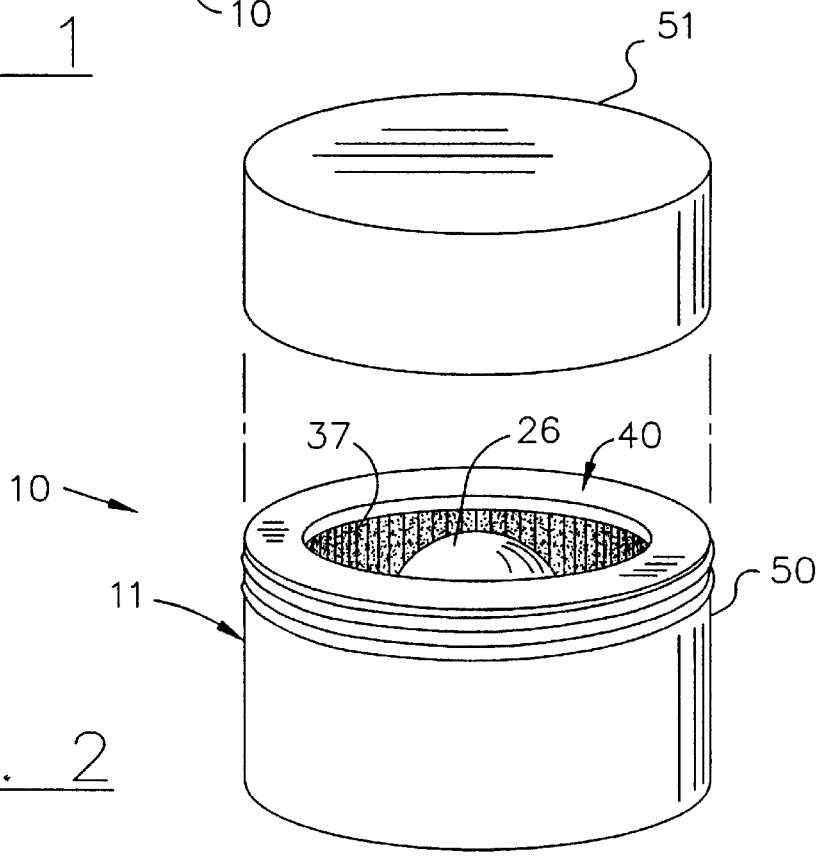
FIG. 2 is an exploded top perspective view of the device of FIG. 1.

Referring more particularly to the drawings, an apparatus for removing fingernail polish and/or artificial fingernails simultaneously from a plurality of fingers is indicated generally at 10 in FIGS. 1–5. The apparatus includes a cup-shaped outer housing or container 11 having a bottom wall 12, a cylindrical side wall 13 and an open top 14. A central round opening 15 is formed through the bottom wall 12 for a purpose to be described hereinafter.

A cup-shaped inner receptacle or container 16 is nested within the outer housing 11 with a light press fit, and has a bottom wall 17, cylindrical side wall 18 and open upper end 19 coterminous with the open top 14. An inner bottom portion of the side wall 18 has a reduced diameter, defining an annular upwardly facing ledge 20, and a radially inwardly projecting rib 21 extends axially upwardly from the ledge 20 and terminates at its upper end spaced below the open upper end 19 of the receptacle 16. See FIGS. 7–8.

Figure 10:
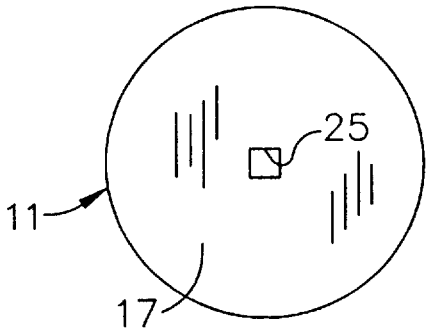
FIG. 10 is a bottom plan view thereof.
Figure 11:
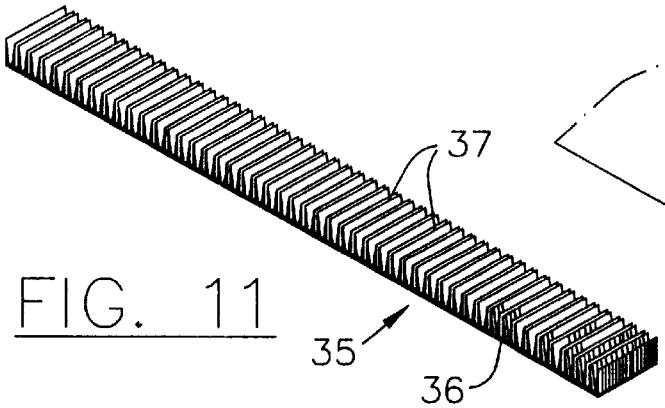
FIG. 11 is a top perspective view, on a reduced scale, of the brush, as manufactured, used in the apparatus of the invention.
Figure 13:
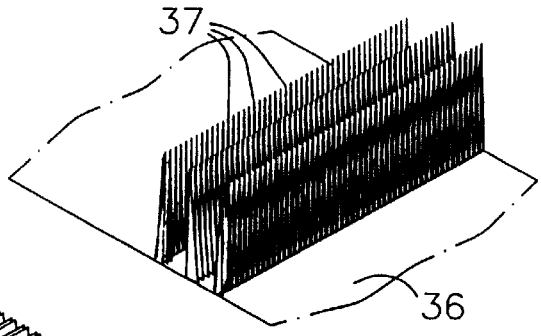
FIG. 13 is an enlarged fragmentary perspective view of a section of the brush of FIGS. 11 and 12.
Figure 12:
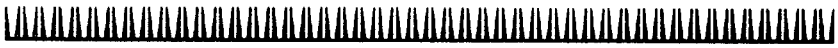
FIG. 12 is a side view in elevation of the brush of FIG. 11, as manufactured.

An upstanding post 22 is formed in the center of bottom wall 17, and projects axially upwardly concentrically with the side wall 18. As seen best in FIGS. 5 and 8, the post 22 extends upwardly a distance approximately equal to half the height of side wall 18, and is diametrically enlarged at its upper end 23, defining an axially downwardly facing annular ledge 24. The post has a hollow interior 25 that is polygonal in transverse cross-section, as indicated best in FIG. 10. When the receptacle 16 is received in the housing 11, the opening 25 is in axial alignment with the opening 15 in bottom wall 12 of the housing 11.

A spherically-shaped finger support and locating device 26 has a truncated bottom side 27 and a cylindrically shaped cavity 28 communicating through the truncated bottom 27 via a reduced diameter opening 29, that defines an annular upwardly facing ledge 30.

The reduced diameter opening 29 and cavity 28 are dimensioned to closely receive the enlarged upper end 23 of post 22, so that the downwardly facing ledge 24 on the post snaps or engages behind the upwardly facing ledge 30 in the finger support, to rotatably mount the support 26 on the post 22.

A circumferential brush member 35 having a backing member 36 and radially inwardly directed bristles 37 is fitted within the receptacle 16 with its bottom annular edge resting on the upwardly facing ledge 20 formed in the receptacle, and its upper annular edge spaced downwardly from the open top 19 of the receptacle.

Figure 7:
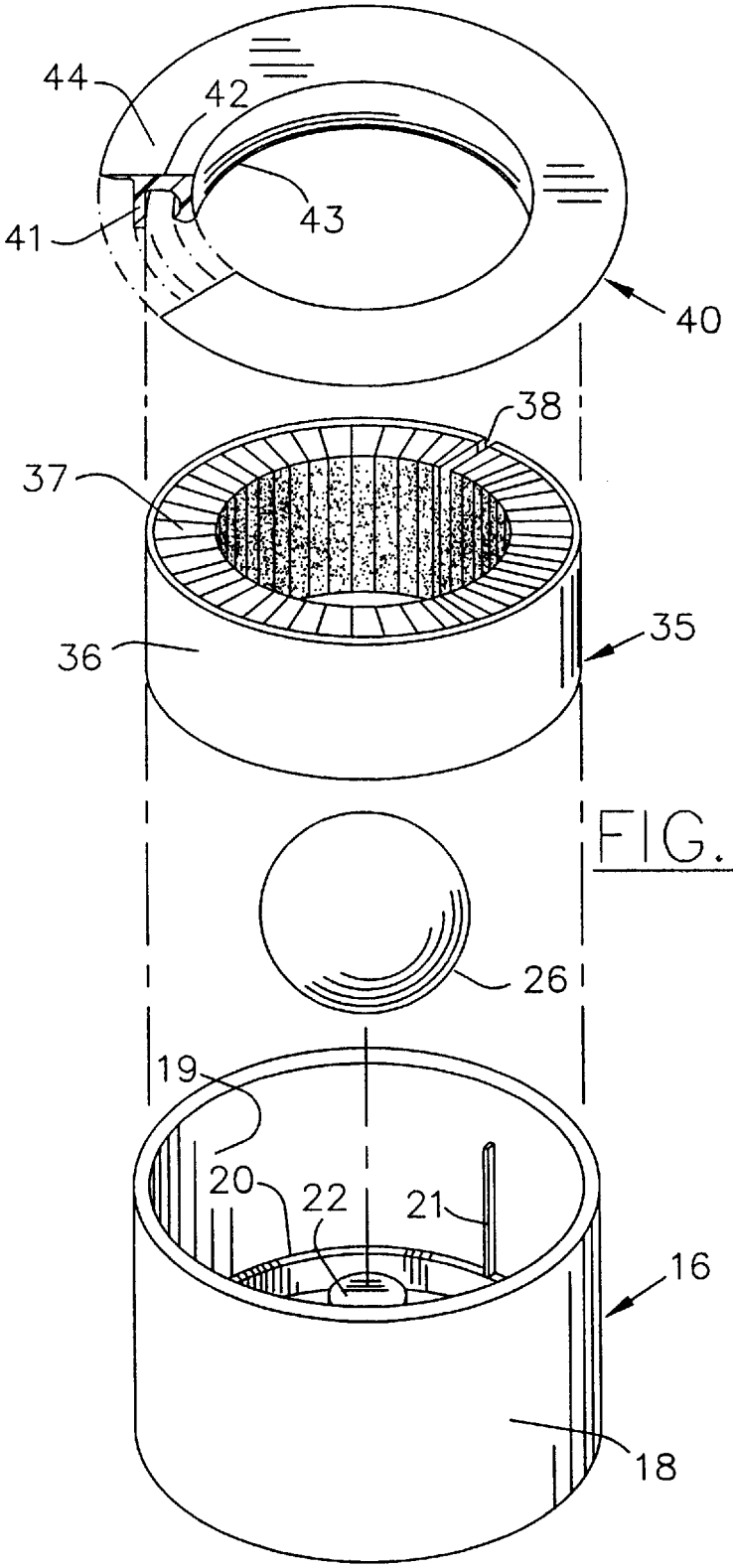
FIG. 7 is an exploded perspective view of the elements used in forming the basic device of the invention, which are, in turn, placed inside an outer housing or container, not shown in this figure.
Figure 9:
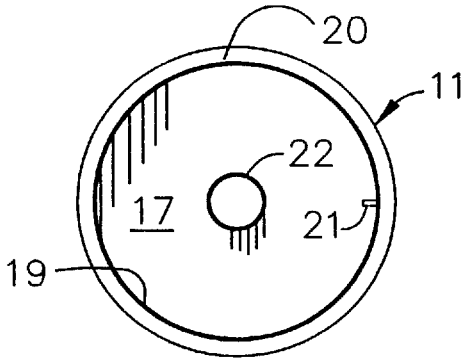
FIG. 9 is a top plan view thereof.
Figure 8:
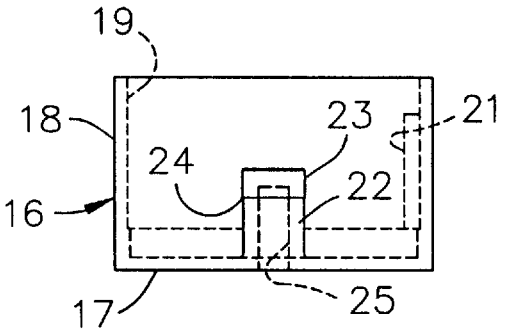
FIG. 8 is a side view in elevation, on a reduced scale, of the solvent-holding receptacle of FIG. 7.

As seen best in FIGS. 7 and 11–13, the brush member 35 is manufactured as a flat strip having a finite length, and is then folded inwardly to form the generally cylindrical or circular configuration seen in FIG. 7, and inserted into the receptacle 16 with the opposed ends 38 of the folded brush member disposed on opposite sides of the axially extending rib 21, to prevent rotation of the brush member relative to the receptacle 16.

Figure 3:
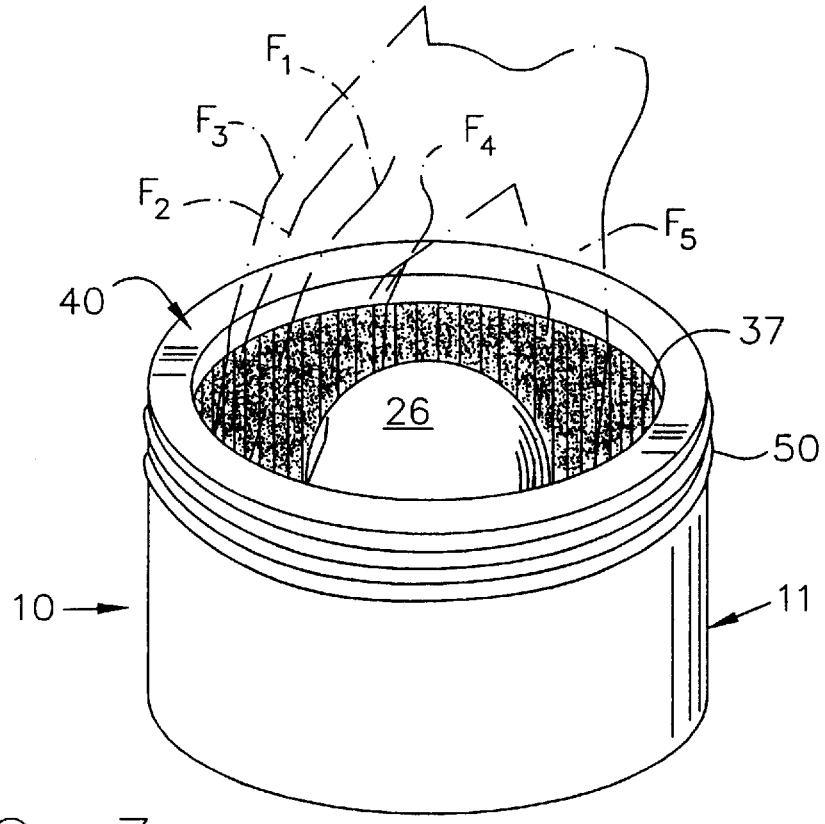
FIG. 3 is a slightly enlarged top perspective view of the device of FIG. 2, showing in dot-and-dash lines how all of the fingers of a wearer's hand may be simultaneously inserted into the open top of the device.
Figure 4:
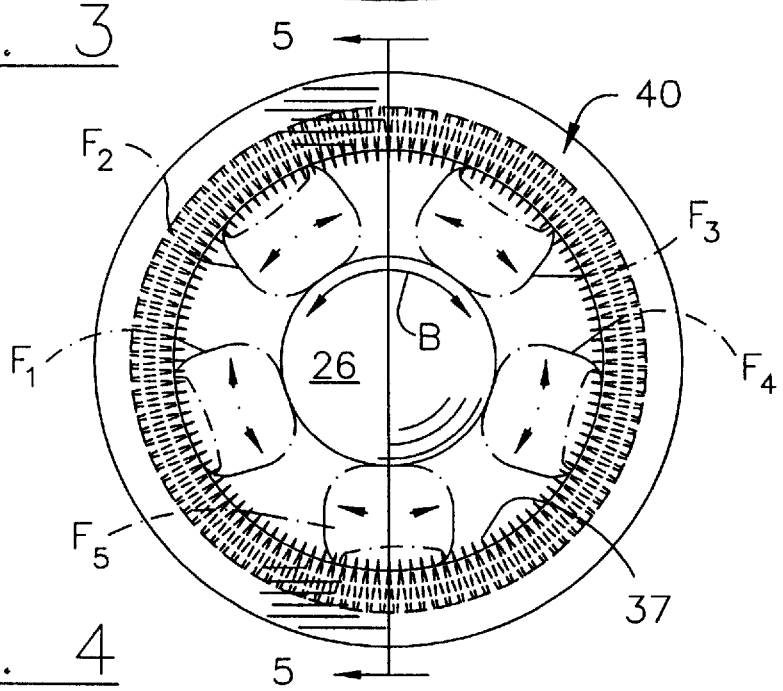
FIG. 4 is a top plan view of the device of FIG. 3, showing in dot-and-dash lines the relative positions of the fingers of the person using the device.
Figure 5:
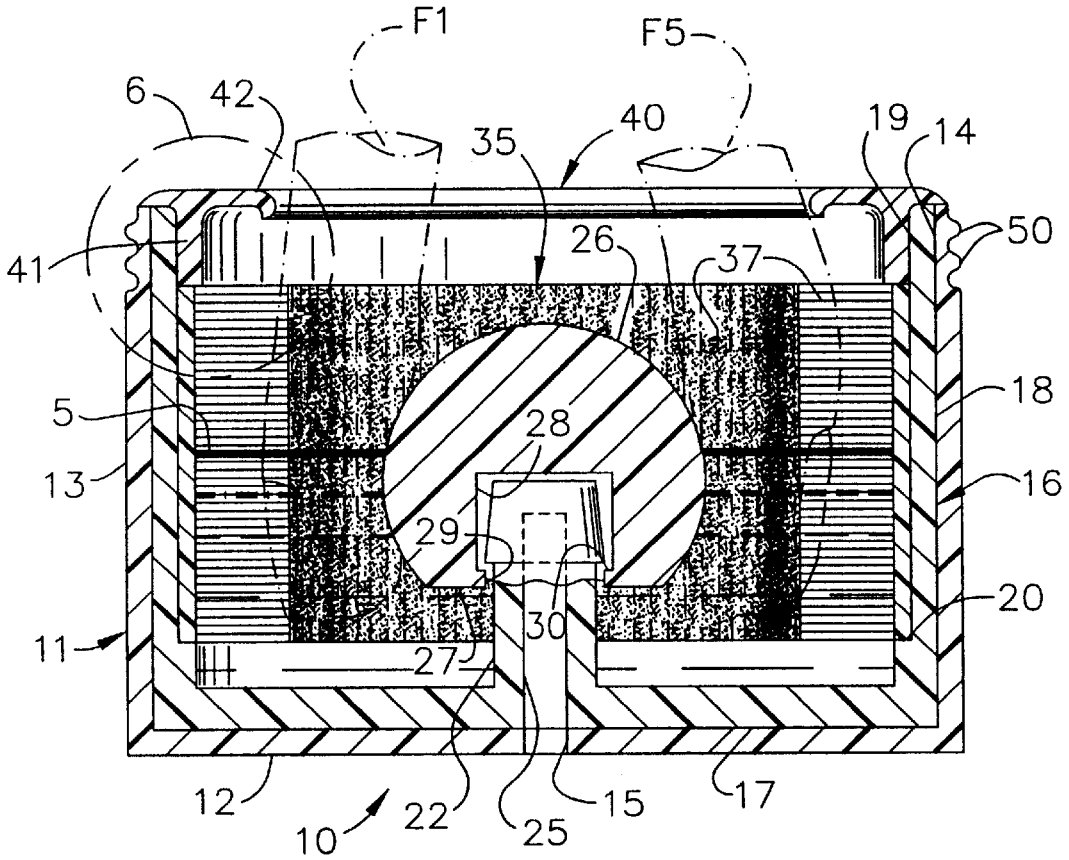
FIG. 5 is a longitudinal sectional view taken along line 5—5 in FIG. 4.

As seen best in FIGS. 3–5, the inner ends of the bristles 37 are spaced radially outwardly from the outer surface of the spherically-shaped finger support 26, defining an annular space between the support 26 and the bristles 37.

Figure 6:
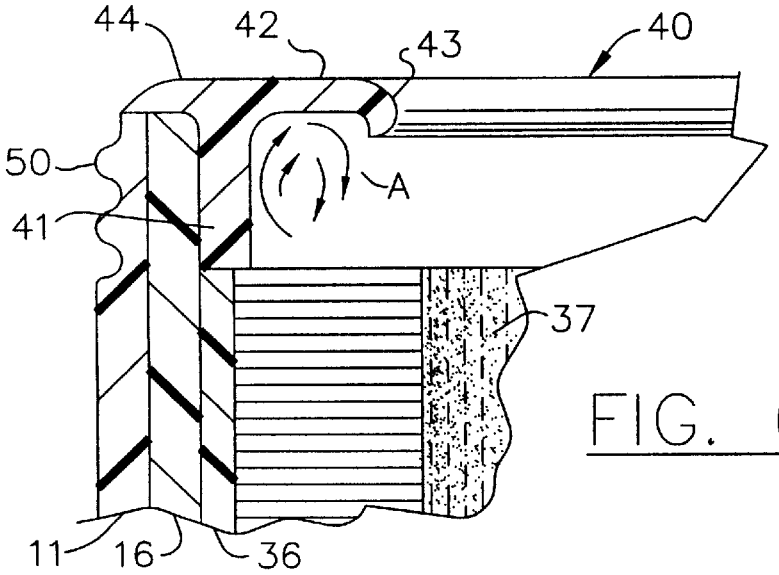
FIG. 6 is an enlarged fragmentary sectional view taken on the circled area 6 in FIG. 5.

An annular splash shield 40 is engaged in the open upper end 19 of the receptacle 16, and includes a depending cylindrical flange or skirt 41 which has a light press fit in the open upper end 19 of the receptacle, and engages at its bottom edge on the top edge of the brush member 35, to hold the brush member against axial displacement. A horizontal flange 42 extends radially inwardly from the upper edge of cylindrical skirt 41 and terminates at its inner edge in a downwardly and inwardly curved lip 43. The flange 42 and curved lip 43 serve to deflect solvent back into the receptacle, as indicated by the arrows A in FIG. 6.

A radially outwardly extending horizontal flange 44 extends outwardly over the upper edges of the inner receptacle 16 and outer housing 11 to provide a finished appearance to these edges, and to locate the splash shield 40 in the open upper end of the inner receptacle.

As seen best in FIGS. 1–3 and 5, an upper outer end portion of the side wall 13 of outer housing 11 is externally threaded at 50 for cooperation with a lid 51 that may be placed over the open end of the housing to close and seal the receptacle when it is not in use, to prevent evaporation or spillage of the solvent contained therein.

A quantity of solvent S, whose primary ingredient may be acetone, but which may also contain other chemicals for conditioning and protecting the skin of a person using the device, is placed in the inner receptacle 16. This solvent may be a liquid or a gel or semi-gel, as desired.

In use, a person desiring to remove fingernail polish and/or artificial fingernails may simultaneously insert all of the fingers $F_1$–$F_5$ into the annular space between the support 26 and the bristles 37, gripping the support 26 with the fingers and then rotating or oscillating the hand back and forth to cause the bristles 37 to exert a scrubbing action on the fingernails, which are also immersed in the solvent S held in the receptacle 16 to soften and dissolve the fingernail polish and/or artificial fingernails. It should be understood that the term "fingers" when used herein refers to all the fingers or digits on a user's hand, including the forefinger, middle finger, ring finger, little finger and thumb. As the fingernail polish and/or artificial fingernails become softened due to the action of the solvent, the scrubbing action of the bristles will remove bits and pieces of the polish or artificial fingernails and will facilitate the dissolving action of the solvent S. By positioning the fingers either higher or lower on the support 26, the angle of exposure of the fingernails to the bristles can be varied, whereby optimum scrubbing action of the bristles on the fingernails can be achieved. In other words, scrubbing action can be concentrated on the tip ends of the fingernails by gripping the support 26 in a higher position, while scrubbing action can be concentrated in the cuticle area of the fingernails by gripping the support 26 in a lower position.

As represented somewhat schematically in FIG. 4, the housing 11, receptacle 16 and the brush member 35 carried thereby remain stationary while the spherically-shaped support 26 and fingers $F_1$–$F_5$ gripping it are moved back and forth through an arc as indicated by the arrow B.

Figure 17:
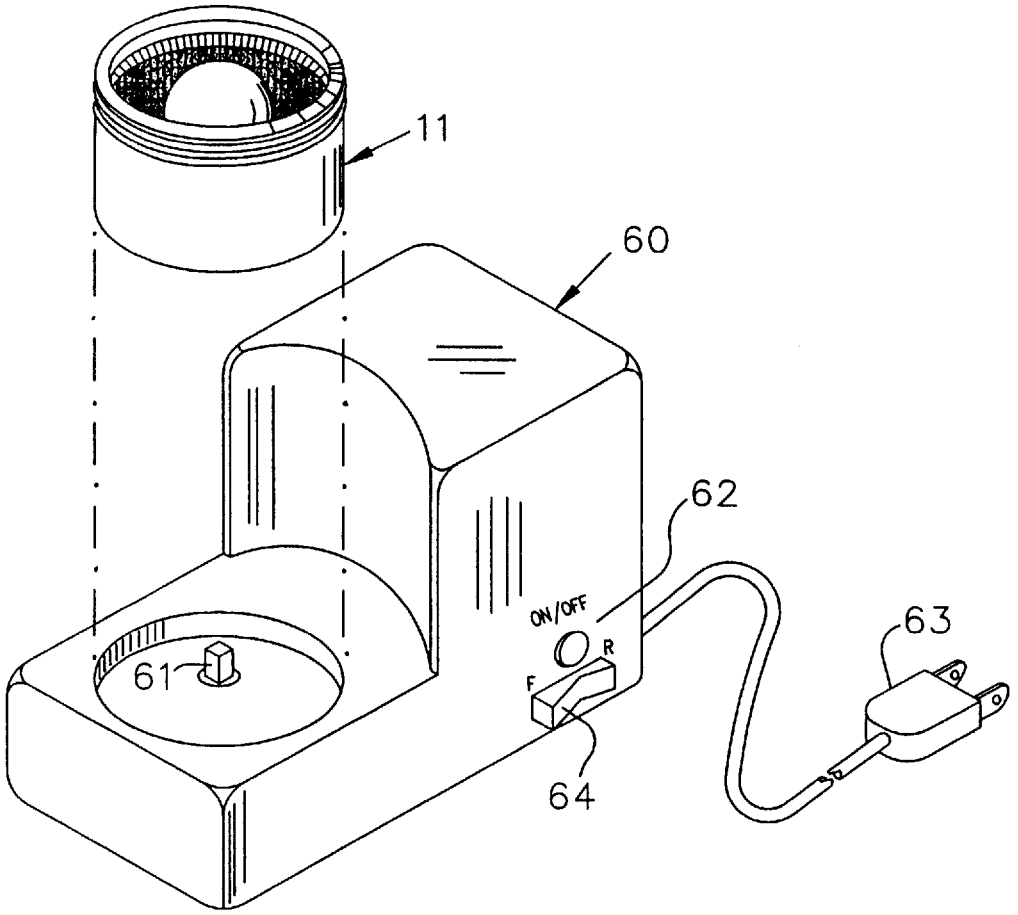
FIG. 17 is an exploded perspective view of a variation of the invention, wherein the device of FIGS. 1–13 is used with a motor driven appliance.

The above-described process is carried out when it is desired to use the apparatus manually, but as indicated in FIG. 17, the receptacle 16 may be placed on a motor driven appliance 60 for mechanized operation of the device. To this end, the appliance 60 includes an upstanding drive post or shaft 61 having a polygonally shaped cross-section complemental to the shape of the polygonally shaped opening 25 in the post 22, and when the receptacle 16 is set on the appliance, this drive shaft 61 extends upwardly into the opening 25 to establish driving connection between the appliance and the receptacle. A suitable on-off switch 62 may be used to control actuation of the appliance, which may be battery operated or may have a power cord 63 adapted to be plugged into a wall receptacle. If desired, the appliance may be constructed to run in both forward and reverse directions, either under control of a suitable timer circuit built into the appliance, or under the control of a forward and reverse switch 64.

Figure 15:
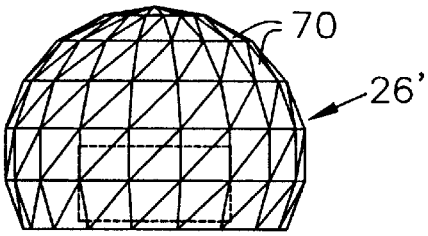
FIG. 15 is a side view in elevation of the modified finger support of FIG. 14.
Figure 14:
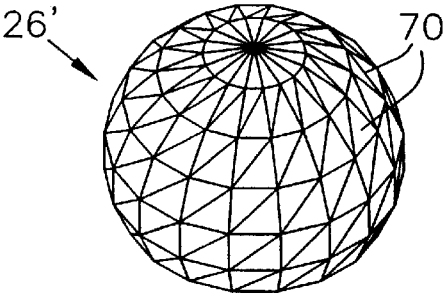
FIG. 14 is a top perspective view of a variation of the finger support used in the apparatus of the invention.
Figure 16:
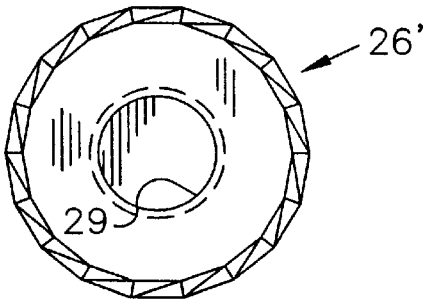
FIG. 16 is a bottom plan view thereof.

If desired, the spherically shaped support 26' may have a faceted outer surface 70 as indicated in FIGS. 14–16. This faceted configuration may take a variety of shapes, including that shown, or a dimpled shape, or shaped finger depressions, etc., as desired. Moreover, the spherical support may be solid as shown in FIG. 5, or it may be hollow. Still further, the support 26 may be rigid or relatively flexible.

In a specific construction of the invention, the outer housing 11 may have an inside diameter of approximately 3.5 inches, and may be made of polypropylene. The inner receptacle 16 may have a light press fit in the outer housing 11, and the cylindrical side wall 18 and bottom wall 17 may have a thickness of approximately ⅛ of an inch. The receptacle 16 may also be made of polypropylene. The splash shield 40 also has a light press fit inside the open upper end of the receptacle 16, and may be made of high density polyethylene. The brush member 35 may be molded from high density polyethylene, and is held in place in the receptacle 16 by engagement of its upper and lower edges between the skirt 41 of the splash shield 40 and the upwardly facing ledge 20 in the receptacle 16. The finger support 26 may be made of low density polyethylene. It should be understood, however, that other materials and dimensions could be employed, as desired or necessary.

Figure 18:
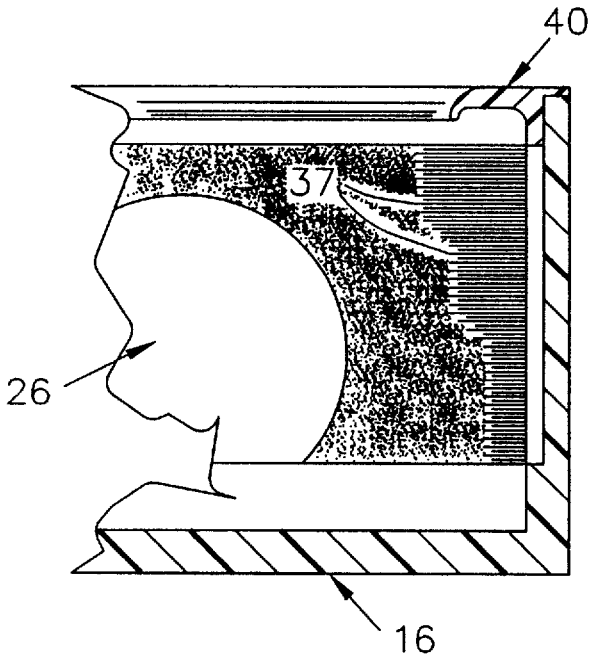
FIG. 18 is a fragmentary longitudinal sectional view of a modification of the bristle configuration, showing bristles of various lengths.

It will be seen that the apparatus of the invention has great versatility, and can be used to clean fingernail polish or artificial fingernails from a plurality of fingers simultaneously, and can be used in either manual or mechanized configurations. Additionally, other types of scuffing devices may be used, rather than the molded plastic bristle member 35 that is specifically illustrated and described herein. For instance, as seen in FIG. 18 the bristles 37' could be slanted in one direction or the other, or could be of varying length, or spaced more closely together in selected areas to achieve different scuffing action depending upon which area of the bristles was used more vigorously.

Figure 19:
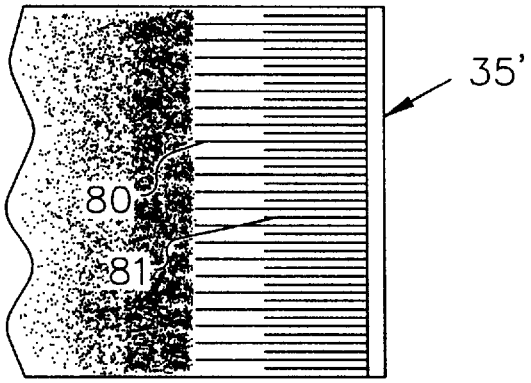
FIG. 19 is a further enlarged fragmentary sectional view of yet another modification in which a combination of hard and soft bristles of different lengths are employed.

FIG. 19 shows another variation of bristle design 35', in which relatively longer, softer bristles 80 are provided in combination with relatively shorter, stiffer bristles 81. By pressing the fingernails against the bristles with enough force to contact only the softer bristles 80, the device can be used effectively to remove fingernail polish, and if pressed harder to engage the stiffer bristles 81, the device is more effective in removing artificial fingernails.

Further, the parts could be secured together other than by a light press fit, or they could even be formed integrally with one another in some instances. Additionally, it should be understood that a different type of splash shield could be used in lieu of the annular guard illustrated and described herein. For example, a slitted flexible diaphragm such as shown in U.S. Pat. Nos. 4,397,324 or 5,054,503, for example, or other type of shield could be used. For that matter, the shield and its function could be omitted, if desired.

While particular embodiments of the invention have been illustrated and described in detail herein, it should be understood that various changes and modifications may be made to the invention without departing from the spirit and intent of the invention as defined by the scope of the appended claims.

What is claimed is:

1. An apparatus for removing fingernail polish and/or artificial fingernails from the fingers of a person, comprising:

a receptacle for holding a quantity of solvent that softens and dissolves fingernail polish and artificial fingernails, said receptacle having opening means in its top through which the fingers of said person may be inserted to immerse the tips of the fingers in solvent contained in the receptacle;

scuffing means disposed in the receptacle adjacent the opening means in a position to be contacted by the fingernails of fingers inserted through the opening means; and finger support means disposed in the receptacle adjacent to but spaced from the scuffing means, defining a space between the finger support means and the scuffing means into which the fingers may be inserted, said finger support means having an axial dimension in the direction of insertion of the fingers into the space, one of said finger support means and said scuffing means being movable relative to the other to enable the user's fingers to grasp the support means and for the scuffing means and fingers to be moved relative to one another to apply a scrubbing action to the fingernails to facilitate dissolving and removal of fingernail polish and/or artificial fingernails from the fingernails of the user, said finger support means being spherically shaped, whereby when the fingers of the user are positioned lower on the support means, greater force is exerted by the scuffing means on the cuticle area of the fingernails, and when the fingers are positioned higher on the support means, greater force is exerted by the scuffing means on the tip areas of the fingernails.

2. An apparatus as claimed in claim 1, wherein:

said receptacle and scuffing means are movable relative to the finger support means and the fingers grasping it during use of the apparatus, for mechanized use.

3. An apparatus as claimed in claim 1, wherein:

said opening means comprises a single large circular opening through which all the fingers of the user's hand can be simultaneously inserted.

4. An apparatus as claimed in claim 3, wherein:

said scuffing means is arranged in a circle around an outer periphery of the opening means, circumscribing a circular space; and said finger support means is supported concentrically within said circular space.

5. An apparatus as claimed in claim 4, wherein:

said scuffing means comprises a brush having radially inwardly directed bristles.

6. An apparatus as claimed in claim 5, wherein:

a splash shield is positioned across the opening means to minimize spillage and/or splashing of solvent from the receptacle.

7. An apparatus as claimed in claim 1, wherein:

said scuffing means comprises a brush.

8. An apparatus as claimed in claim 7, wherein:

said scuffing means is arranged in a circle around an outer periphery of the opening means, circumscribing a circular space; and said finger support means is supported concentrically within said circular space.

9. An apparatus as claimed in claim 1, wherein:

a splash shield is positioned across the opening means to minimize spillage and/or splashing of solvent from the receptacle.

10. An apparatus for removing fingernail polish and/or artificial fingernails from the fingers of a person, comprising:

a receptacle for holding a quantity of solvent that softens and dissolves fingernail polish and artificial fingernails, said receptacle having opening means in its top through which the fingers of said person may be inserted to immerse the tips of the fingers in solvent contained in the receptacle;

scuffing means disposed in the receptacle adjacent the opening means in a position to be contacted by the fingernails of fingers inserted through the opening means;

finger support means disposed in the receptacle in spaced relationship to the scuffing means, defining a space between the finger support means and the scuffing means into which the fingers may be inserted, said finger support means being shaped to support the fingers thereon in different orientations, depending upon the position of the fingers relative to the support means, whereby pressure between the scuffing means and different portions of the fingernail may be accomplished by repositioning the fingers on the support means, to enable the user to exert greater scuffing action on those portions of the fingernail where desired; and an annular splash shield positioned around the periphery of the circular opening, said splash shield having a curved return at an inner margin thereof to redirect splashed solvent back into the receptacle, said curved inner margin also preventing discomfort to the user upon contact between the fingers of the user and the inner margin of the splash shield.

11. An apparatus for removing fingernail polish and/or artificial fingernails from the fingers of a person, comprising:

a receptacle for holding a quantity of solvent that softens and dissolves fingernail polish and artificial fingernails, said receptacle having opening means in its top through which the fingers of said person may be inserted to immerse the tips of the fingers in solvent contained in the receptacle;

scuffing means disposed in the receptacle adjacent the opening means in a position to be contacted by the fingernails of fingers inserted through the opening means; and finger support means disposed in the receptacle in spaced relationship to the scuffing means, defining a space between the finger support means and the scuffing means into which the fingers may be inserted, said finger support means being shaped to support the fingers thereon in different orientations, depending upon the position of the fingers relative to the support means, whereby pressure between the scuffing means and different portions of the fingernail may be accomplished by repositioning the fingers on the support means, to enable the user to exert greater scuffing action on those portions of the fingernail where desired, wherein said finger support means has portions spaced closer to and portions spaced farther from the scuffing means, in the direction of insertion of fingers into the space, to cause the fingers to be positioned closer to or farther away from the scuffing means, and in different orientations relative to the scuffing means, when the fingers grip the support means in different axial positions thereon, to concentrate the force of the scuffing means on different portions of the fingernails, whereby scuffing action may be selectively concentrated on the tips, cuticles or other portions of the fingernail.

12. An apparatus as claimed in claim 11, wherein:

said opening means comprises a single large circular opening through which all the fingers of the user's hand can be simultaneously inserted.

13. An apparatus as claimed in claim 12, wherein:

said scuffing means is arranged in a circle around an outer periphery of the opening means, circumscribing a circular space; and said finger support means is supported concentrically within said circular space.

14. An apparatus as claimed in claim 13, wherein:

said scuffing means comprises a brush having radially inwardly directed bristles.

15. An apparatus as claimed in claim 14, wherein:

said support means is spherically shaped, whereby when the fingers of the user are positioned lower on the support means, greater force is exerted by the scuffing means on the cuticle area of the fingernails, and when the fingers are positioned higher on the support means, greater force is exerted by the scuffing means on the tip areas of the fingernails.

16. An apparatus as claimed in claim 15, wherein:

an annular splash shield is positioned around the periphery of the circular opening, said splash shield having a curved return at an inner margin thereof to redirect splashed solvent back into the receptacle, said curved inner margin also preventing discomfort to the user upon contact between the fingers of the user and the inner margin of the splash shield.

17. An apparatus as claimed in claim 11, wherein:

said finger support means and scuffing means are movable relative to one another to enable a user's fingers to grasp the support means and for the scuffing means and fingers to be moved relative to one another to facilitate dissolving and removal of fingernail polish and/or artificial fingernails from the fingernails of the user.

18. An apparatus as claimed in claim 17, wherein:

the finger support means and the fingers grasping it are movable relative to the scuffing means during use of the apparatus.

19. An apparatus as claimed in claim 17, wherein:

said scuffing means is movable relative to the finger support means and the fingers grasping it during use of the apparatus.

20. An apparatus as claimed in claim 19, wherein:

motor means is connected to the scuffing means to cause it to move relative to the finger support means and fingers.

21. An apparatus as claimed in claim 20, wherein:

said scuffing means and receptacle are connected for movement together relative to the finger support means and the fingers grasping it.

22. A method of removing fingernail polish and/or artificial fingernails, comprising the steps of:

simultaneously inserting all the fingers of one hand through an opening means and into a receptacle containing a solvent for softening and dissolving fingernail polish and/or artificial fingernails, and immersing the tips of the fingers in the solvent;

placing the fingernails of said one hand into contact with a scuffing means in the receptacle which removes bits of fingernail polish and/or artificial fingernails as they are softened and dissolved, while maintaining the fingernails wetted with the solvent;

placing the fingers against a finger support in the receptacle adjacent to but spaced from the scuffing means and having a shape to automatically position the fingernails closer to or farther away from the scuffing means and in different angular orientations relative to the scuffing means as the fingers are placed in different axial locations on the finger support, to concentrate pressure between the scuffing means and different parts of the fingernails; and causing the scuffing means and fingertips to move relative to one another to hasten the dissolving action of the solvent and to scuff away bits and pieces of fingernail polish and/or artificial fingernails.

23. A method as claimed in claim 22, wherein:

said opening means comprises a single large opening through which all the fingers can be simultaneously inserted.

24. A method as claimed in claim 23, wherein:

said opening means is circular, and the fingers may be inserted through the opening in any rotational position relative thereto.

25. An apparatus for removing fingernail polish and/or artificial fingernails from the fingers of a person, comprising:

a receptacle for holding a quantity of solvent that softens and dissolves fingernail polish and/or artificial fingernails, said receptacle having a top and opening means in the top through which the fingers of said person may be inserted to immerse the tips of the fingers in solvent contained in the receptacle; and scuffing means disposed in the receptacle adjacent the opening means in a position to be contacted by the fingernails of fingers inserted through the opening means to scuff the fingernails and hasten the dissolving action of the solvent, said scuffing means comprising a brush member manufactured as a flat strip with opposite ends and a backing member having bristles projecting from one side, said flat strip being coiled and inserted into said receptacle and arranged in a circular configuration around said opening means with the bristles projecting radially inwardly and the opposite ends of the strip engaged with a stop means in the receptacle to prevent rotational movement of the brush member in the receptacle.

26. An apparatus as claimed in claim 25, wherein:

the receptale has a circular interior wall adjacent said opening means and said backing member is engaged against and conforms to the shape of the receptacle interior wall, and said stop means comprises a rib on said interior wall between the opposite ends of the brush member.

27. Brush means for scuffing fingernails of a person to faciliate the dissolving action of a solvent on fingernail polish and/or artificial fingernails when they are exposed to the solvent and scuffed with the brush means, said brush means comprising:

a brush having a backing member with bristles projecting from one side thereof, said bristles being of different lengths to achieve different scuffing action depending upon which area of the bristles is used more vigorously or contacted with the fingernails.

28. Brush means as claimed in claim 27, wherein:

longer, softer bristles are uniformly interspersed in combination with shorter, stiffer bristles, whereby when the fingernails are pressed against the bristles with enough force only to contact the softer bristles, the brush is effective to facilitate removal of nail polish, and when pressed with enough force to engage the stiffer bristles, the brush is effective to facilitate removal of artificial fingernails.

29. Brush means as claimed in claim 27, wherein:

the bristles have different lengths in different areas of the brush to achieve different scuffing action on different parts of the fingernail, depending upon the position of the fingernail relative to the different areas of the bristles.

30. Brush means as claimed in claim 29, wherein:

the brush is manufactured in a flat, elongate, rectangularly shaped strip having opposite side edges, and the bristles are shorter along one side edge than along the other.

31. An apparatus for removing fingernail polish and/or artificial fingernails from the fingers of a person, comprising:

a cylindrical receptacle for holding a quantity of solvent that softens and dissolves fingernail polish and artificial fingernails, said receptacle having circular opening means in its top through which the fingers of said person may be inserted to immerse the tips of the fingers in solvent contained in the receptacle;

brush means disposed in the receptacle and arranged in a circle adjacent the opening means around an outer periphery of the opening means in a position to be contacted by the fingernails of fingers inserted through the opening means, said brush means being manufactured as a flat strip with an elongate, rectangularly shaped backing member having bristles projecting from one side, said strip being coiled into a circular shape and inserted into the receptacle with the bristles projecting radially inwardly, circumscribing a circular space;

spherically shaped finger support means supported concentrically in said circular space in spaced relationship to the brush means, defining a space between the finger support means and the brush means into which the fingers may be inserted, said spherically shaped finger support means being shaped to support the fingers thereon in different orientations, depending upon the position of the fingers relative to the support means, whereby pressure between the brush means and different portions of the fingernail may be accomplished by repositioning the fingers on the support means, to enable the user to exert greater scuffing action on those portions of the fingernail where desired; and an annular splash shield positioned and supported in the receptacle around the periphery of the circular opening, said splash shield having a curved return at an inner margin thereof to redirect splashed solvent back into the receptacle, said curved inner margin also preventing discomfort to the user upon contact between the fingers of the user and the inner margin of the splash shield, and said splash shield serving to retain said brush means in place in the receptacle.

32. An apparatus as claimed in claim 31, wherein:

the support means is stationary and the brush means is movable.

33. An apparatus as claimed in claim 32, wherein:

the brush means is power driven to rotate about a longitudinal central axis of the support means.

34. An apparatus as claimed in claim 31, wherein:

the brush means is stationary and the support means is rotatable relative thereto.

* * * * *